United States Patent [19]

Kiedaisch

[11] Patent Number: 4,705,208

[45] Date of Patent: Nov. 10, 1987

[54] ARTICLE DISPLAY CARTON

[75] Inventor: Randall A. Kiedaisch, Bourbonnais, Ill.

[73] Assignee: Manville Corporation, Denver, Colo.

[21] Appl. No.: 10,072

[22] Filed: Feb. 2, 1987

[51] Int. Cl.[4] ..... B65D 5/26; B65D 25/54

[52] U.S. Cl. ..... 229/120.08; 229/162; 229/167; 229/169; 206/45.31

[58] Field of Search ..... 206/45.31, 45.33; 229/27, 162, 167, 169, 904

[56] References Cited

U.S. PATENT DOCUMENTS

| | | | |
|---|---|---|---|
| 2,170,723 | 8/1939 | Marx | 206/45.33 |
| 2,334,985 | 11/1943 | Berry | 229/167 |
| 2,346,206 | 4/1944 | Broderick | 229/27 |
| 2,678,766 | 5/1954 | Lerkoff | 229/162 |
| 2,755,982 | 7/1956 | Vanderlugt, Jr. | 229/167 |
| 3,545,666 | 12/1970 | Visvydas | 229/169 |
| 3,905,543 | 9/1975 | Randles | 229/167 |
| 4,305,544 | 12/1981 | Noonan | 229/169 |
| 4,354,596 | 10/1982 | Lavery | 229/162 |
| 4,438,846 | 3/1984 | Stylianov | 229/162 |

*Primary Examiner*—Stephen Marcus
*Assistant Examiner*—Brenda J. Ehrhardt
*Attorney, Agent, or Firm*—John D. Lister; Cornelius P. Quinn; Timothy R. Schulte

[57] ABSTRACT

A multiple article display carton having the end walls of the display cells spaced from the end panels of the carton. Instead of gluing the end closure flaps together the top panel is provided with three foldably connected flaps designed to provide the assembly with a force or friction fit. The first flap is folded down to become the end panel of the carton, the second flap is folded up on the other side of the first flap with the transversely extending side panel flaps therebetween, and the third flap extends from the end panel to the end cell wall to hold the end cell wall in place.

12 Claims, 17 Drawing Figures

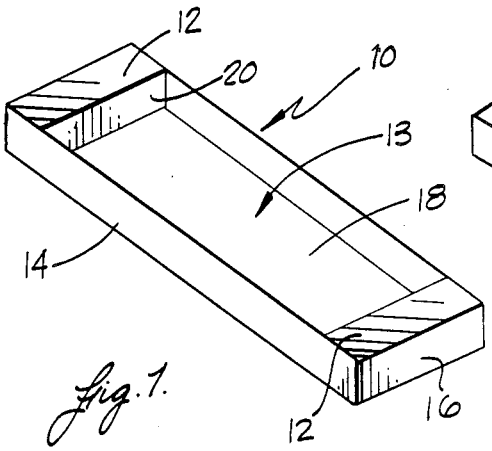
Fig. 1.
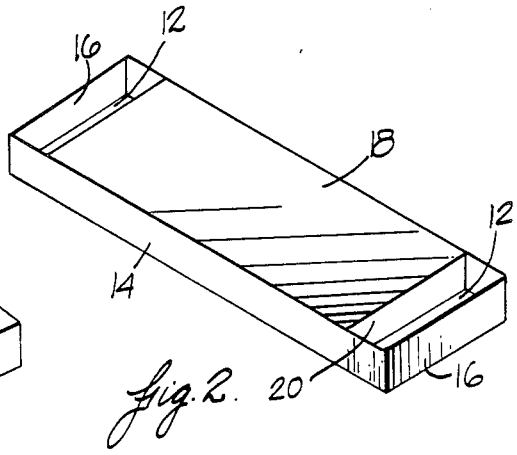
Fig. 2.
Fig. 3.
(PRIOR ART)
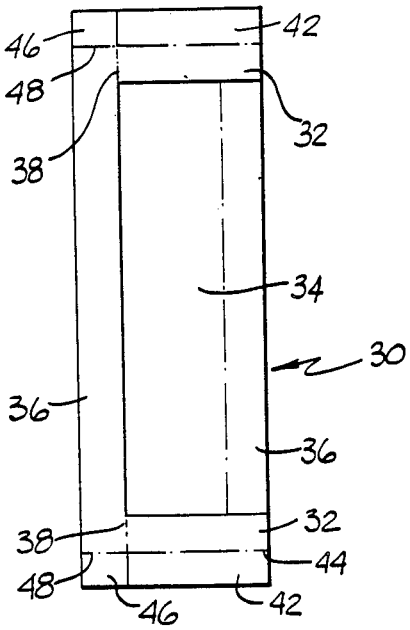
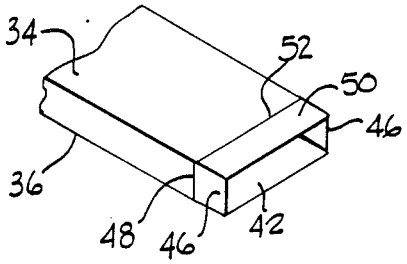
Fig. 4.
(PRIOR ART)
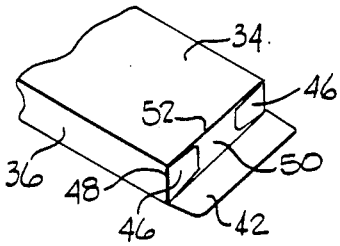
Fig. 5.
(PRIOR ART)

Fig. 11.
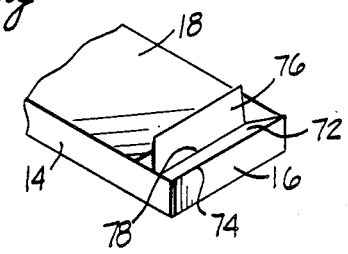
Fig. 12.
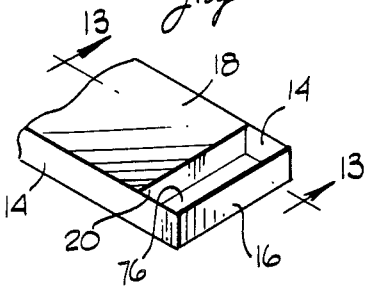
Fig. 13.
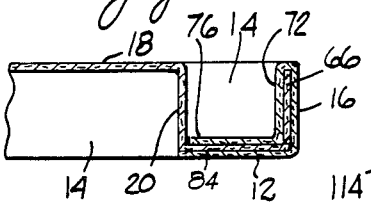
Fig. 14.
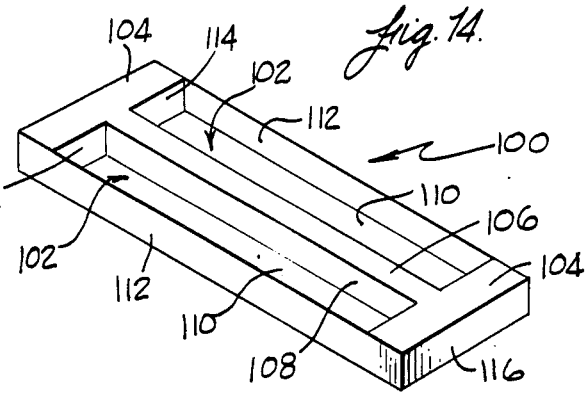
Fig. 15.
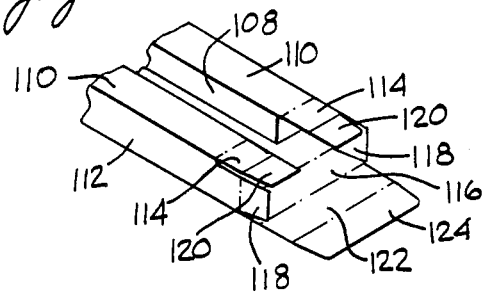
Fig. 16.
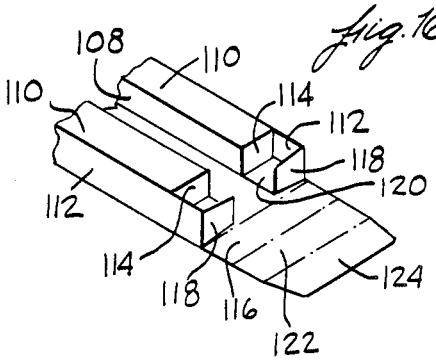
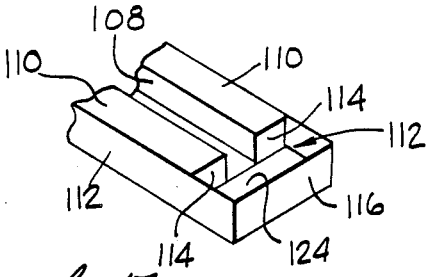
Fig. 17.

ARTICLE DISPLAY CARTON

FIELD OF THE INVENTION

This invention relates to multiple article display cartons, and more particularly to a multiple article display carton in which the end panel of the carton is spaced from the end wall of the cell in which the articles are contained.

BACKGROUND OF THE INVENTION

Cartons for packaging and displaying articles such as candy typically are provided with open cells for receiving and displaying the candy. A clear plastic wrapper is used to cover the opening to the cell in order to retain the candy in the carton. Usually, the cutout portion in the top panel which allows a person to see into the cell terminates short of the ends of the carton so that the top panel portions adjacent the panel ends can be imprinted with graphics.

The cartons are shipped to the packager in the form of flattened or collapsed sleeves which contain the necessary fold lines and cutouts to permit fabrication of the carton. Such blanks are generally provided with an end flap arrangement consisting of dust flaps extending from the side panels of the carton and an end carton flap bonded to the dust flaps. The bonding of the flaps is usually achieved by heating preapplied adhesive to activate it. The resulting carton is satisfactory in performance but is relatively costly to fabricate because of the expensive gluing operation. In addition to the cost of the preapplied glue itself, the energy required to heat the adhesive and the extra time it takes to activate the adhesive and hold the flaps together until bonded add significantly to the cost of fabrication.

It would obviously be advantageous to have a multiple article display carton which provides all the benefits of the currently available cartons but which is more economical to produce.

BRIEF SUMMARY OF THE INVENTION

This invention provides a more economical carton by doing away with the need for end flap adhesive. Yet the carton is strong and the end flap arrangement is secure and able to readily withstand the stresses of handling and shipping. This has been accomplished by providing a unique friction lock to hold the end flaps in place. More specifically, the top panel is provided with foldably connected flaps, the first of which is folded down against the outer faces of the dust flaps, the second of which is folded up against the inner faces of the dust flaps, and the third of which is wedged between the end wall of the display cell and the end panel created by the combined structure of the first two flaps and the dust flaps. Although the carton may be fabricated by machine, it also lends itself to fabrication by hand, which is advantageous in cases of short runs or runs of specialized sizes or designs.

Other features and aspects of the invention, as well as its various benefits, will become more clear in the detailed description of the preferred embodiment which follows.

BRIEF DESCRIPTION OF THE DRAWINGS

FIG. 1 is a pictorial representation of a single-celled article display carton of the present invention;

FIG. 2 is a pictorial representation similar to that of FIG. 1, but showing the underside of the carton;

FIG. 3 is a top plan view of a collapsed blank used in fabricating a typical prior art single-celled article display carton;

FIG. 4 is a partial pictorial representation of the bottom side of one end of the prior art display carton blank of FIG. 3, shown after the collapsed blank has been set up and is ready for fabrication;

FIG. 5 is a view similar to that of FIG. 4, but showing the blank after it has been partially folded;

FIGS. 8–12 are views similar to that of FIG. 7, but showing the blank in sequential stages of fabrication, the fully fabricated carton end being shown in FIG. 12;

FIG. 13 is a partial sectional view of the fully fabricated carton taken on line 13—13 of FIG. 12;

FIG. 14 is a pictorial representation of the upper side of a display carton of the present invention having two spaced parallel cells;

FIG. 15 is a partial pictorial representation of the bottom side of the display carton of FIG. 14, showing one end of the blank after it has been set up and is ready for fabrication;

FIG. 16 is a view similar to that of FIG. 15, but showing the blank in an intermediate stage of fabrication; and FIG. 17 is another view similar to that of FIG. 15, but showing the carton end after the carton has been fully fabricated.

DESCRIPTION OF THE INVENTION

Figure 6:
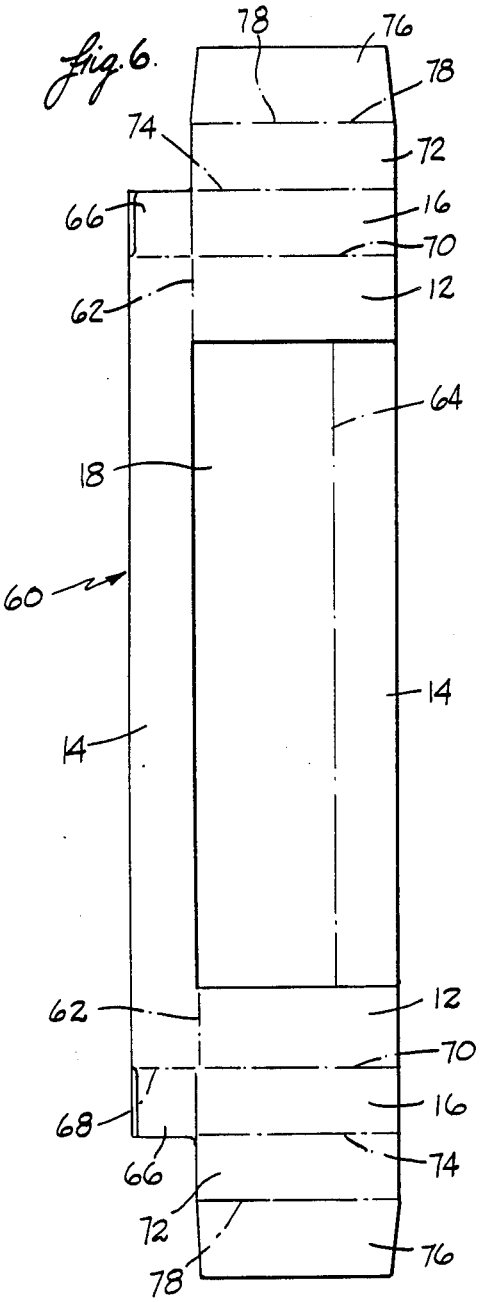
FIG. 6 is a top plan view of a collapsed blank used in fabricating a single-celled article display carton of the present invention.

Referring to FIG. 1, the display carton 10 comprises a top panel 12 foldably connected to side panels 14 and end panels 16. The side panels are further foldably connected to bottom panel 18. The top panel 12 is cut away in the area of a single cell 13, the bottom wall of which is formed by bottom panel 18, the side walls of which are formed by side panels 14 and the end walls of which are formed by walls 20. End walls 20 are thus separated from the end panels 16 by the distance that top panel 12 extends inwardly from the end panels 16. Although the contents of the carton are not shown, it is to be understood that candy or other articles would be contained in the cell 13 and could be seen through a clear wrapper, not shown, which prevents the articles from falling out.

As shown in FIG. 2, the bottom side of the carton 10 illustrates the arrangement wherein the bottom panel 18, which is also the bottom wall of the cell 13, terminates at the end walls 20 of the cell, leaving an open space at each end of the carton bounded by the end wall 20, the end panel 16 and the end portions of the side panels 14. The open space is the result of the mechanical fastening arrangement which enables the display carton of the present invention to be fabricated without the use of adhesive.

In order to more clearly appreciate the distinctions between the present invention and commonly used prior art cartons, a typical prior art carton blank is shown in FIG. 3, and the steps of fabricating the blank into a display carton are shown in FIGS. 4 and 5. Referring first to FIG. 3, the carton blank 30 comprises sections 32 which correspond to the top panel of the carton formed from the blank, section 34 which corresponds to the bottom panel of the carton, and sections 36 which correspond to the side panels of the carton and which are connected to sections 32 and 34 by fold lines 38 and 40, respectively. Flaps 42, connected to sections 32 by fold lines 44, correspond to the end panels of the carton, as do similar flaps connected to section 34, not visible in FIG. 3. The flaps 46, connected by fold lines 48 to the section 36 shown on the left of the drawing, correspond to the dust flaps located on one side of the carton. Similar flaps, not visible in this view because covered by flaps 42, are also connected to the section 36 shown on the right side of the drawing, and they correspond to the dust flaps located on the other side of the carton. The blank as viewed in FIG. 3 is in collapsed condition. To set it up for fabrication the sections 36 are folded up to the vertical, thereby elevating the sections 32 from section 34.

Referring to FIG. 4, the prior art carton blank 30 is shown as it would appear after the sections 36 have been folded up to separate the sections 32 and 34. In order to better contrast the folding operations of the present invention with those of the prior art, the set-up blank has been shown in the same manner that the carton of the present invention is shown, with the section 34 in the uppermost position. In this view the flap 50, which is similar to flap 42, is visible and is shown connected to section 34 by fold line 52. As illustrated the flaps 42, 46 and 50 have not yet been folded along their fold lines.

FIG. 5 illustrates a later stage of fabrication of the prior art carton as it would appear after flap 50 has been folded down and dust flaps 46 have been folded against it. At this point flap 42 would then be folded up against the flap 50 and dust flaps 46 to complete the end panel structure. It should be understood that the dust flaps 46 would have been glued to flap 50 and the flap 42 would be glued to flap 50 and dust flaps 46 in order to hold the plaps in place and give the carton structure the required rigidity. This entire operation would be carried out by an automatic fabricating machine which is required due to the necessary heating of the preapplied adhesive on the affected flap portions and the pressure which must be applied in order to hold the components in place until the adhesive has bonded the flaps together. Since the interior ends of the top panel portions 32 are unsupported between the side panels, the top panel is limited in the distance it can be extended from the end panels, thereby limiting the space which can be provided for graphics.

Referring now to FIG. 6, the collapsed blank 60 of the present invention, which is used to form the carton 10 of FIGS. 1 and 2, comprises section 12 corresponding to the top panel 12 of the carton 10, sections 14 corresponding to the side panels, and section 18 corresponding to the bottom wall of the cell 13. The sections 14 are connected to the section 12 by fold lines 62, and to section 18 by fold lines 64. Dust flaps 66 are connected to sections 14 by fold lines 68, while flaps 16, which correspond to the end panels of the carton, are connected to sections 12 by fold lines 70.

In addition to the structure described thus far, the blank 60 also includes flaps 72 connected to the flaps 16 by fold lines 74, and additional flaps 76 connected to the flaps 72 by fold lines 78.

Figure 7:
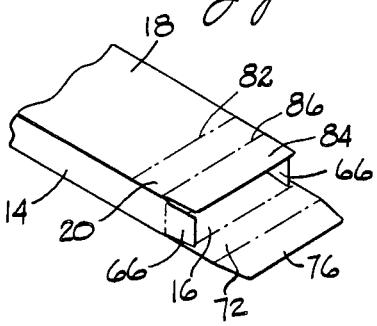
FIG. 7 is a partial pictorial representation of the bottom side of one end of the display carton blank of FIG. 6, shown after the collapsed blank has been set up and is ready for fabrication.

In a view similar to that of FIG. 4, FIG. 7 shows the blank of FIG. 6 after the side panels 14 have been folded up to expand the collapsed blank. As in FIG. 4, the set-up blank is shown with the bottom cell wall 18 exposed to view in order to more clearly depict the end structure of the panel, and with the top panel supporting the carton and being hidden from view. Instead of a single flap extending from the bottom wall, as in the prior art arrangement, the present invention employs two flaps. Flap 20 is connected to bottom cell wall 18 by fold line 82, and flap 84 is connected to flap 20 by fold line 86.

Figure 8:
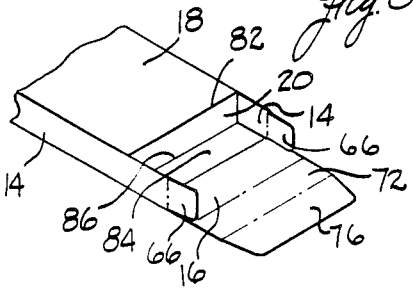

As shown in FIG. 8, the first step in forming the end wall of the cell is to fold lap 20 down about fold line 82 until the flap is perpendicular to the bottom wall 18. At the same time the flap 84 is folded up about fold line 86 to a position perpendicular to the flap 20. By these steps the flap 20 becomes the end wall of the cell and the interior side of flap 84 is in engagement with the interior side of the top panel 12, providing a double thickness of material at this location. The distance the flap 20 extends from its fold line 82 is the same as the depth of the cell. Preferably, the distance the flap 84 extends from its fold line 86 is the same as the distance the top panel extends inwardly from the end panel, although it is not essential that this relationship exist.

Figure 9:
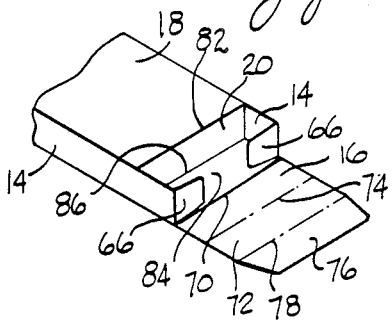

Referring to FIG. 9, the next step is to fold in the dust flaps 66 so that they are perpendicular to the side panels 14. If the flap 84 extends all the way to this point the dust flaps would abut the outermost edge of the flap 84 at the lowermost edges of the dust flaps. In any case, there is a substantial gap between the folded-in dust flaps and the end cell wall 20.

Figure 10:
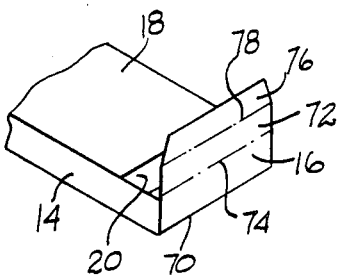

As shown in FIG. 10, the next step in the fabrication of the carton is to fold up flap 16 about its fold line 70 so that its interior face is in contact with the outer faces of the dust flaps. The remaining two flaps 72 and 76 are then folded about their fold lines 74 and 78 in accordion fashion so that the interior face of flap 72 contacts the interior faces of dust flaps 72 and 76 and the interior face of flap 76 overlies and is in contact with the outer face of flap 84. The folding operation of this last step is shown as it would appear in progress in FIG. 11, and the bottom of one end of the finished carton is shown in FIG. 12.

The relationship of elements in the finished carton is shown more clearly in section in FIG. 13, wherein it can be seen that the cell bottom wall 18 is folded so that flap 20 becomes the end cell wall. It can also be seen that the top wall 12 is folded so that flap 16 on the one side and flap 72 on the other sandwich the dust flaps 66 to form the end panel of the carton. The flap 76, connected to the flap 72, extends between flap 72 and flap 20 and is dimensioned so that there is a relatively tight force fit of the flap 76 between the end wall of the cell and the end panel of the carton. Thus the end edge of the flap 76 frictionally contacts the flap 20 and, due to its snug fit, holds the end walls of the cell and the carton substantially rigid and upright.

The invention is not limited to a carton containing only a single cell. FIG. 14, for example, shows a display carton 100 which contains two cells 102. In this arrangement the top panel 104 includes a center strip 106 extending from one end of the top panel to the other. Foldably connected to the strip 106 are interior cell walls 108, which also are foldably connected to the bottom cell walls 110. The other sides of the bottom cell walls are foldably connected to the side panels 112 of the carton so that the outer walls of the cells are formed by the side panels of the carton and the inner walls of the cells are formed by the cell walls 108. As in the single-celled embodiment, the end walls 114 of the cells are inwardly spaced from the end panels 116 of the carton. The center strip 106 thus separates the cutout portions of the upper panel leading to the interior of the cells.

The expanded double-celled carton blank shown in FIG. 15 corresponds to the expanded single-celled blank shown in FIG. 7 in that both represent carton blanks that have been set up and are ready for fabrication. The flaps 114 and the further flaps 120 foldably attached thereto correspond to flaps 20 and 84 of FIG. 7, while flaps 116 and connected flaps 122 and 124 correspond to flaps 16, 72 and 76 of FIG. 7.

The stage of assembly of the double-celled carton blank illustrated in FIG. 16 corresponds to the stage of assembly of the single-celled blank in FIG. 9. The stage corresponding to FIG. 8 has been omitted because the steps involved have been described in detail in connection with that view. Referring to FIG. 16, it can be seen that flaps 114 have been folded down to form the end walls of the cells 102, and the connecting flaps 120 have been folded up to lie flat against the top panel 104. The dust flaps 118 have been folded perpendicular to the side panels 112 and are spaced from the flaps 114. From this stage it is apparent that the flaps 116, 122 and 124 will be folded in the manner depicted in FIGS. 10 and 11 in order to reach the final desired carton configuration illustrated in FIG. 17. As in the single-celled embodiment shown in FIG. 12, the finished carton includes an end panel 116 spaced from the end cell walls 114, and the flap 124 holds the end structure in place by the same mechanism described in connection with FIGS. 12 and 13.

The significant features of this invention are not limited in use to the two specific embodiments described. Obviously, modifications can be made to the cells, such as providing compartments within the cells to hold individual articles or providing even more cells than two.

The unique arrangement of this invention enables display cartons to be fabricated without the costly gluing operation, yet without losing the strength necessary to support the articles being carried and to withstand the stresses caused by shipping and handling. Further, by using a mechanical locking system instead of the usual adhesive arrangement the cartons can be fabricated by hand, making it practical to ship out only limited numbers of filled cartons, which would not be economical if the cartons had to be fabricated by machine. In addition, because the top panel is supported at both the end panel and the end cell wall, it can extend inwardly from the end panel for a relatively great distance, making possible the printing of graphics over a larger expanse than was previously possible.

Although more paperboard is used in the carton of this invention compared to the usual adhesively bonded cartons, the cost of the extra small amount of paperboard is much more offset by the savings accured by not having to use adhesive. For example, the use of preapplied adhesive carton blanks can readily cost in the order of 30% more than the mechanical carton of the present invention due to the cost of the adhesive, the application of it to the blanks, the heating of it in the fabrication machine, and the slow fabrication time caused by the heating and pressure applying steps during fabrication.

It should not be obvious that although preferred embodiments of the invention have been described, changes to certain specific details of the embodiments can be made without departing from the spirit and scope of the invention as defined in the claims.

What is claimed is:

1. A multiple article display carton containing at least one cell for receiving articles to be packaged and displayed, wherein each cell has a bottom wall connected to side walls and end walls, the carton comprising:

a top panel containing a cutout associated with each cell, enabling the contents of the cell to be viewed, side panels connected to the top panel, each side panel comprising a side wall of a cell, at least one of the end walls of each cell comprising a flap foldably connected to the bottom wall of the cell, the side panels of the carton extending a substantial distance beyond the end wall of their associated cell and having a flap foldably connected thereto, the side panel flaps extending transversely of the side panels and being substantially parallel to and spaced from the end wall of their associated cell, the top panel of the carton extending beyond the aforesaid end wall of the cell and having a first foldably connected flap contacting the outer faces of the side panel flaps to form a part of the end panel of the carton, the top panel having a second flap foldably connected to the first flap and contacting the inner faces of the side panel flaps to complete the formation of the end panel of the carton, the top panel having a third flap foldably connected to the second flap and extending from the inner faces of the side panel flaps to the end wall of the cell, whereby the free end of the third flap contacts the end wall of the cell to form a friction lock against the end wall of the cell.

2. A display carton according to claim 1, wherein the carton contains only a single cell.

3. A display carton according to claim 1, wherein the carton contains two cells.

4. A display carton according to claim 3, wherein the interior side walls of the cells are spaced from each other and the outer side walls of the cells are formed by the side panels of the carton.

5. A display carton according to claim 1, wherein the opposite end walls of the cell are similar in construction and the opposite end panels of the carton are similar in construction.

6. A display carton according to claim 1, including additionally a second flap foldable connected to the flap forming the end wall of the cell, the second end wall flap being situated between the top panel extension and the third top panel flap.

7. A display carton according to claim 1, wherein the area of the top panel between the end panel and the adjacent end wall of the cell is large enough to receive graphics of substantial size and amount.

8. A display carton according to claim 1, wherein the end panel structure is held in place by the friction lock without the use of any adhesive.

9. A display carton according to claim 1, wherein the open faces of the cells are covered by a clear wrapper.

10. A blank for forming a multiple article display carton containing at least one cell for receiving articles to be packaged and displayed in the carton, comprising:

a top panel containing a cutout associated with each cell of the carton, the top panel being foldably connected by side panels to the bottom wall of at least one cell, the top and side panels and the bottom cell wall being substantially parallel to each other in the form of a flattened sleeve, at least one end of the bottom wall terminating a substantial distance short of the adjacent end of the top panel, a flap connected by a fold line to said one end of the bottom wall of the cell and adapted to be folded up to become the end wall of the cell, the side panels of the carton extending substantially the same distance beyond the end of the bottom wall as the top panel of the carton, each side panel having a flap connected thereto by a fold line, the flaps being adapted to be folded toward each other transversely of the side panels and parallel to the end wall of the cell, a first flap connected to the end of the top panel by a fold line and being adapted to be folded up against the outer faces of the side panel flaps when in their transversely folded position, a second flap connected to the first top panel flap by a fold line and being adapted to contact the inner faces of the side panel flaps when in their transversely folded position, and a third flap connected to the second top panel flap by a fold line and being adapted to extend from the inner faces of the transversely folded side panel flaps to the end wall of the cell so that the free end of the third flap contacts the end wall of the cell to form a friction lock against the end wall of the cell.

11. A blank according to claim 10, including additionally a second flap connected to the bottom wall flap by a fold line and adapted to underlie the top panel between the end wall of the cell and the transversely folded side panel flaps, the third top panel flap adapted to underlie the second bottom wall flap.

12. A blank according to claim 10, wherein the top panel contains a strip extending along the length of the central portion thereof, two interior cell walls being connected by fold lines to the side edges of the strip and to two spaced bottom cell walls, the outer side walls of the cells being the side panels of the carton, whereby when the collapsed blank is folded into an open sleeve it will contain two cells adjacent the side edges of the carton sleeve separated from each other by a central spacer strip.

* * * * *